United States Patent [19]

Baumann

[11] Patent Number: 4,972,584

[45] Date of Patent: Nov. 27, 1990

[54] HAIRCUTTING AND TRIMMING DEVICE

[76] Inventor: John H. Baumann, 601 Almarida Dr. #F2, Campbell, Calif. 95008

[21] Appl. No.: 496,420

[22] Filed: Mar. 20, 1990

[51] Int. Cl.[5] ..... B26B 19/14; B26B 19/20

[52] U.S. Cl. ..... 30/133; 30/201

[58] Field of Search ..... 30/133, 201, 200, 41.5, 30/210

[56] References Cited

U.S. PATENT DOCUMENTS

| | | | |
|---|---|---|---|
| 1,331,218 | 2/1920 | Severson | 31/1 |
| 2,946,123 | 7/1960 | Bray | 30/219 |
| 3,035,346 | 5/1962 | Campbell | 30/133 |
| 3,063,146 | 11/1962 | Bray | 30/133 |
| 3,979,825 | 9/1976 | Baumann | 30/133 |
| 4,188,720 | 2/1980 | Korf | 30/133 |
| 4,216,581 | 12/1980 | Van Slooten | 30/133 |
| 4,219,931 | 9/1980 | Vacilotto | 30/133 |
| 4,590,675 | 5/1986 | Louw | 30/133 |
| 4,628,601 | 12/1986 | Van Slooten | 30/133 |
| 4,670,982 | 6/1987 | Kim | 30/133 |
| 4,679,322 | 7/1987 | Hunts | 30/133 |
| 4,704,794 | 11/1987 | Paradis | 30/133 |
| 4,843,717 | 7/1989 | Crane | 30/133 |

FOREIGN PATENT DOCUMENTS 3118643 11/1982 Fed. Rep. of Germany ..... 30/133

*Primary Examiner*—Douglas D. Watts

[57] ABSTRACT

A manually portable haircutting and trimming device comprising haircutting blades located in a tubular housing, a motor located at one end of the housing having the dual purpose of driving the haircutting blades and providing a vacuum source for drawing hair from the scalp of a user into the cutting blades and depositing cut hair into a hair storing compartment within the housing, thereby making the haircutting device fully selfcontained. Special air guide means are included to ensure that all hair that enters the hair cutting device, will be cut by the cutting blades. Releasably unidirectional, incrementally adjustable length control means are included to selectively control length of hair remaining on the scalp at various locations as well as means to facilitate crew-cuts, and taper cuts. Special means are included to permit Afro hair cuts without straightening out the curly hair before cutting. Cut-by-numbers means are incorporated permitting the use of hairstyling diagrams with preselected patterns.

14 Claims, 4 Drawing Sheets

HAIRCUTTING AND TRIMMING DEVICE

BACKGROUND OF THE INVENTION

This invention relates to devices for cutting and trimming hair and more particularly to haircutting devices having adjustable length control and incorporating a vacuum for drawing the hair into the cutting area and removing the hair after cutting.

The present applicant was granted U.S. Pat. No. 3,979,825 in Sept. of 1976, showing a novel and effective structure using hair guide deflector means for cutting hair to a predetermined length. Hair length can be varied on different areas of the scalp by adjustment of the position of a length control tube and hair styling diagrams using a cut-by-numbers system enable the hair cutting device to reproduce a variety of hairstyles.

The prior art set out in U.S. Pat. No. 3,979,825 forms part of the prior art in this application and is incorporated herein by this reference. The present invention incorporates modifications and improvements to this prior art and discloses an even more facile manner of accomplishing the objects of the prior art as well as enabling the haircutting device to cut and style very curly hair, so-called Afro styled hair and to controlably make tapered haircuts.

OBJECTS OF THE INVENTION

I addition to having all of the objects of U.S. Pat. No. 3,979,825 it is an object of this invention to provide a haircutting device which is compact and light weight by utilizing only one motor to provide both a vacuum source to draw hair into the region of the cutting blades for cutting and remove cut hair as well as to drive oscillating action of the cutting blade to cut hair, thereby making it fully self contained and independent of outside vacuum means.

It is also an object of this invention to provide a haircutting device that incorporates an easily opened compartment for storing cut hair, making it fully self contained and hygienic in that it does not soil the surroundings with cut hair.

It is another object of this invention to provide a haircutting device which contains handle means that may easily be rotated on the housing of the device, relative to the cutting edge of the cutter blades, to permit a left handed or a right handed operator to use the device with equal ease on his or her own hair.

It is a further object of this invention to provide a haircutting device which may be used to cut very curly hair, so-called Afro styled hair, by employing a special type of means for varying the distance between the scalp and the cutting blades, without excessively disturbing the curly hair and without permitting the vacuum means to straighten the curly hair before cutting it.

It is also an object of this invention to provide a haircutting device that includes taper guide means to permit controlled tapering of the length of the finished hair over a small area of the scalp, so that hair may be cut, not only to controlably fixed lengths on different parts of the head, but also to lengths gradually changing from one length to another at various angles of taper in transition areas.

It is still further an object of this invention to provide a haircutting device that is entirely self contained yet sufficiently light weight and compact to permit one-handed manipulation of the device by a user on his or her own hair without the user becoming unduly fatigued thereby.

BRIEF DESCRIPTION OF THE DRAWINGS

In the following description the same reference numeral is used throughout the various figures of the drawings to denote the same part.

Referring to FIGS. 1, 2 and 3, a preferred embodiment of a haircutting device, utilizing the present invention is shown, generally indicated by the reference numeral 10, comprising a substantially tubular housing 11, that has an open end 12 and an opposite end 13, opposite end 13 in this particular embodiment being closed by a filter 14. A conventional type of oscillating hair clipper cutter 15 is located within housing 11, substantially transversely of housing 11 and substantially adjacent to open end 12 thereof. Cutter 15 has a cutting edge 16 supplied with a stationary plate 17 carrying a set of stationary cutting teeth 18 and an oscillating cutting teeth member 19 to provide a hair clipper cutter of a type well known in the oscillating hair clipper cutter art. Cutting edge 16 is located transversely within housing 11 and substantially centrally thereof. Stationary plate 17 is firmly attached to one inner wall 20 of tubular housing 11 and sealed thereto along all edges of plate 17 except along cutting edge 16.

Figure 1:
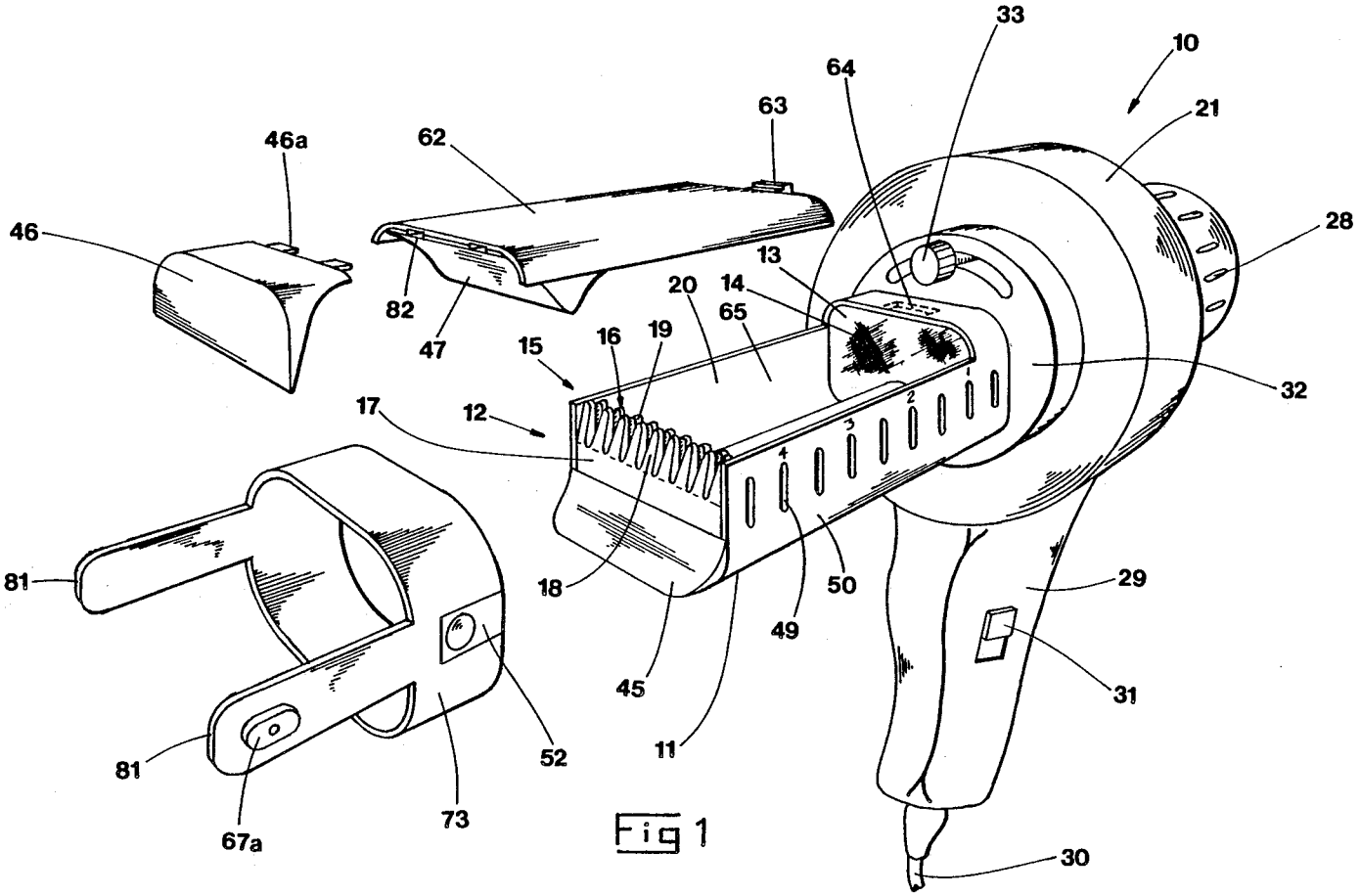
FIG. 1 is an exploded, perspective view of one preferred embodiment of a haircutting device incorporating the principles of the present invention.

A motor housing 21 is attached at opposite end 13 of tubular housing 11 and contains a motor 22 having an axle 23 that extends towards opposite end 13 and carries a pinion gear 24, axle 23 being located parallel to and substantially coincident with axis 25 of housing 11. An impeller 26 is located on axle 23 to provide a vacuum within housing 11 upon motor 22 being activated, air being drawn in through open end 12, as shown at 27, and expelled through exhaust slots 28 in motor housing 21.

Handle means 29 is attached to one side of motor housing 21 and carries electrical cord means 30 and switch means 31 for switching motor 22 on and off during operation of haircutting device 10. Motor housing 21 is rotatably mounted on a flange 32 located on opposite end 13 of tubular housing 11 to permit motor housing 21 with handle means 29 to be rotated relative to cutting edge 16 to facilitate use of haircutting device 10 by a right-handed or left-handed operator, particularly when the operator is utilizing haircutting device 10 to cut his or her own hair. A chosen relative position between motor housing 21 and cutting edge 16 may be maintained by clamping screw means 33 or any suitable, conventional clamping means.

A cutter drive axle 34 is located within tubular housing 11, substantially parallel to axis 25 and extends from cutter 15 to pinion gear 24 and carries an eccentric crank 35 at cutter drive end 36, closest to cutter 15, crank 35 being adapted to engage in a slot 37 located in conventional manner in oscillating cutting teeth member 19 to activate oscillating motion of oscillating cutting teeth member 19. The other end 38 of drive axle 34 carries a drive gear 39 that engages with pinion gear 24. It will be seen that since motor axle 23 with pinion gear 24 is located coincident with axis 25 of tubular housing 11, pinion gear 24 will remain in correct engagement with drive gear 39 upon motor housing 21 being rotated about axis 25 from one position to another position on opposite end 13 of tubular housing 11.

Figures 2, 11, 12:
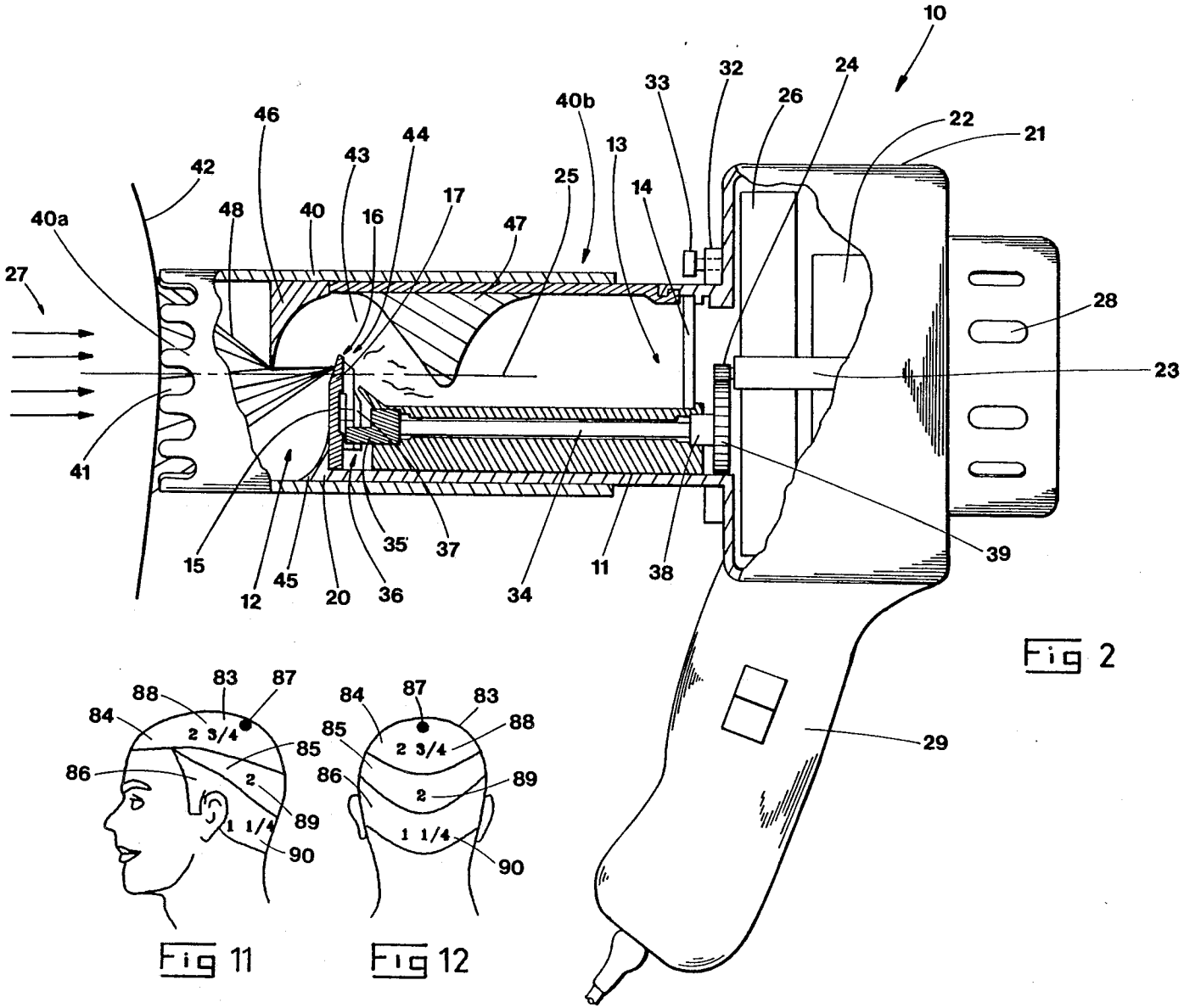
FIG. 2 is a side elevational, part midvertical sectional view of the haircutting device shown in FIG. 1.
FIG. 11 illustrates a method of providing programming means for utilization in conjunction with the present invention, showing in side elevation, a hair length map covering a particular hair style to be cut, the hair length map being divided into zones, with each zone being marked with its own particular hair length.
FIG. 12 is an example of an auxiliary mapped illustration of the style shown in FIG. 4, showing a view taken of the rear of the head marked with zones corresponding to those shown on FIG. 4, to be used in conjunction with a picture of the finished hair style.
Figures 3, 4, 5:
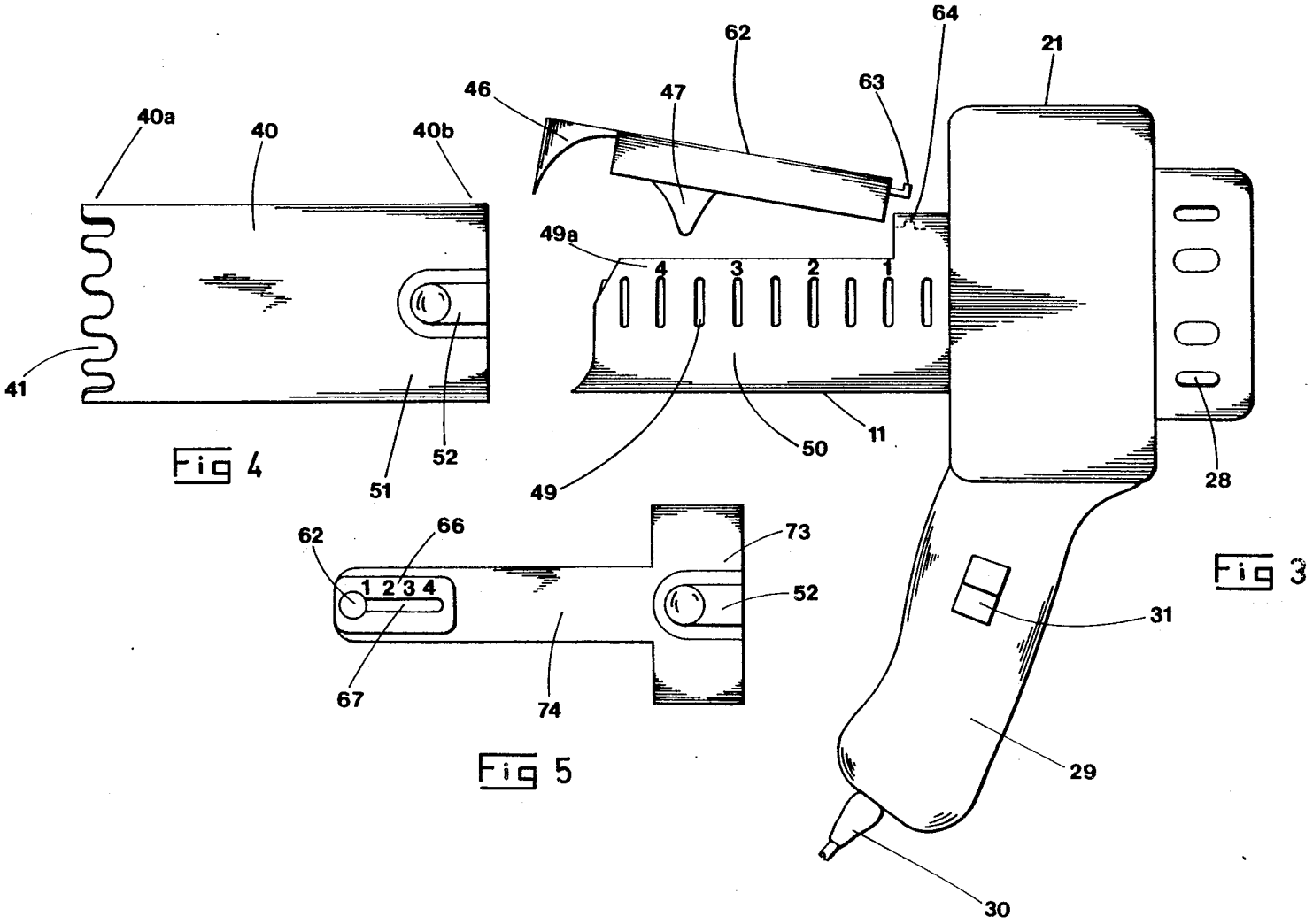
FIG. 3 is a side elevation of the haircutting device shown in FIG. 1, without an extendable tube located thereon and with the hair storage department cover shown lifted up from the hair storage compartment of the device.
FIG. 4 is a side elevation of an extendable tube adapted to be used in conjunction with the haircutting device shown in FIG. 1 to provide variable lengths of cut hair.
FIG. 5 is a side elevation of an alternate extendable tube to be used in conjunction with the haircutting device for cutting very curly hair.
Figure 8:
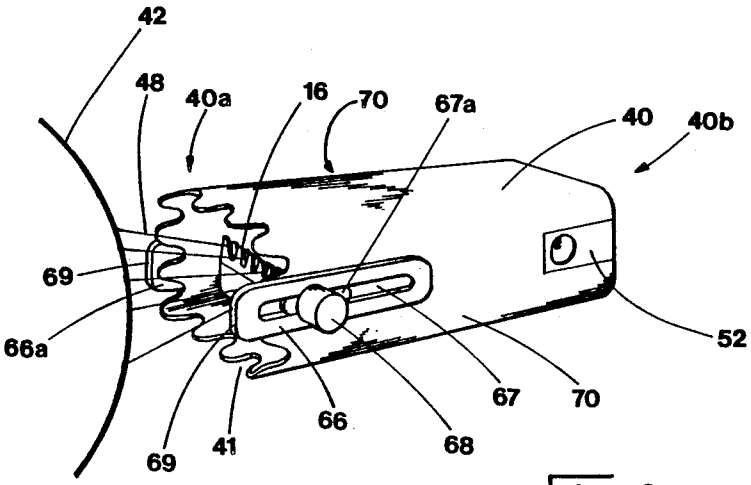
FIG. 8 is a perspective view of the extendable tube shown in FIG. 4 for clarity shown removed a short distance from the scalp, illustrating two extendable prongs located on opposite sides of the extendable tube for providing controlably tapered haircuts and for cutting very curly hair.

Referring particularly to FIGS. 2, 4 and 8, a telescoping, extendable tube 40 is located axially slideable on tubular housing 11, extendable tube 40 having an open end **40*a* and an opposite end 40*b*, open end 40*a* being supplied with a plurality of vacuum breaking slots 41, to permit ingress of air into haircutting device 10 and to prevent suction within haircutting device 10 from holding on to scalp 42 of the hair being cut, slots 41 being of sufficient width and length to permit easy movement of haircutting device 10 over scalp 42 without any overt suction being felt, yet permitting sufficient suction to draw hair in through open end 12 to cutter 15**.

In order to ensure that substantially all hair, that enters open end 12 of haircutting device 10, is forced to pass through and be cut by cutter 15, and to increase open airflow area to provide adequate suction power at cutter 15, an air channel 43 has been positioned above and around cutting teeth location 44, air channel 43 being formed by a primary airguide 45 which directs airstream 27, entering open end 12 of tubular housing 11, upwards toward cutting teeth location 44, a secondary air guide 46 and a tertiary airguide 47, which in conjunction change direction of airstream 27 to force airstream 27 around and down behind oscillating teeth member 19 and toward impeller 26, thereby forcing any hair strands 48, that have entered open end 12 with airstream 27, into cutting teeth location 44 where hair strands 48 are cut to predetermined length from scalp 42, determined by axial position of extendable tube 40 on tubular housing 11. In this preferred embodiment tubular housing 11 has been shown with a substantially rectangular cross-section to permit maximum air stream velocity for airstream 27 around cutter 15, but this cross-section could be circular or of any other desired configuration.

Figure 7:
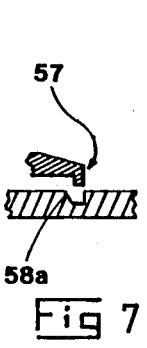
FIG. 7 is a partial, midsectional plan view of the extendable tube shown in FIG. 4 illustrating an alternate detent lever mechanism.
Figure 6:
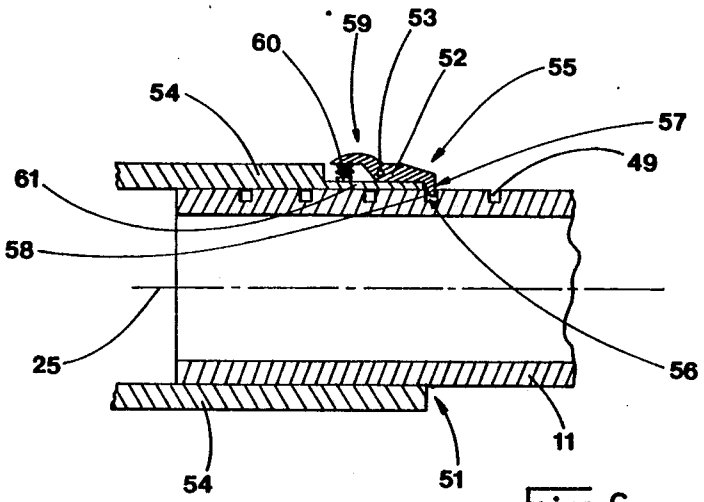
FIG. 6 is a partial, midsectional plan view of the extendable tube shown in FIG. 4 illustrating a preferred detent lever mechanism for incrementally varying cut hair length.

Referring to FIGS. 3, 6 and 7, a plurality of incrementally spaced, shallow notches 49 are located externally in a sidewall 50 of tubular housing 11. Extendable tube 40 is supplied at its end **40*b*, opposite to end 40*a*, with a spring biased, pivoted detent lever 52, pivoted at pivot 53 in wall 54 of extendable tube 40. Free end 55 of detent lever 52 has an inward extending nose 56 adapted to engage in shallow notches 49, outer end 57 of nose 56 is substantially perpendicular to axis 25, inner end 58 of nose 56 being slanted toward pivot 53 to permit nose 56 to freely slide out of engagement with notches 49 upon extendable tube 40 being pulled away from motor housing 21. To move nose 56 out of engagement with a notch 49 in order to move extendable tube 40 toward motor housing 21, it is necessary to move nose out of notch 49, this requirement thereby providing a failsafe feature, in that hair can not be accidentally cut too short by pressure of extendable tube 40 on scalp 42 inadvertently moving extendable tube 40 in toward motor housing 21. Manual end 59 of detent lever 52 is supplied with a spring 60 located between a portion 61 of extendable tube wall 54 and manual end 59, thereby biasing free end 55 of detent lever 52 toward and into shallow notches 49. Spring 60 is of suitable tension to permit forceable sliding of extendable tube 40 on housing 11 axially away from motor housing 21 to provide rapid axial adjustment of extendable tube 40 outward from open end 12, notches 49 will provide definite increments of adjustment equal to increments of pitch in spacing of shallow notches 49 along sidewall 50 of housing 11. The same object may be accomplished by slanting one edge 58*a*, closest to open end 12, of each notch 49 as shown in FIG. 7. Length indicating means 49*a* may be marked on housing 11 near pertinent notches 49**.

Referring to FIGS. 1 and 3, an upper portion of housing 11 is formed as a removable cover 62 extending from open end 12 of housing 11 substantially to filter 14, cover 62 being supplied with hook means 63 at the end closest to filter 14 adapted to hook into a suitable recess 64 in housing 11, cover 62 being adapted to be located into place on housing 11 by inserting hook means 63 into recess 64 and snapping cover 62 downwards onto housing 11. An enclosed cut hair compartment 65 is thereby formed within tubular housing 11, between hair cutter 15 and filter 14, removable cover 62 permitting cut hair compartment 65 to be easily emptied as required upon cover 62 being removed. Secondary airguide 46 may be detachably attached to cover 62 as shown in FIG. 1 to permit cutting close to scalp 42 upon removal of secondary airguide 46, and tertiary airguide 47 may be attached to cover 62 to facilitate cleaning of cutter 15 upon removal of cover 62.

Figure 9:
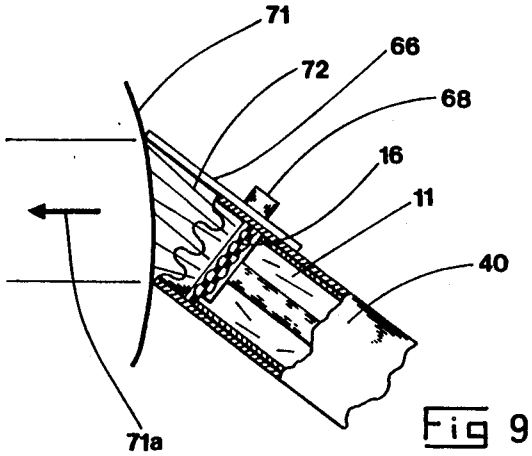
FIG. 9 is a part midvertical sectional, partial, side elevation of the haircutting device shown in FIG. 1, illustrating method of providing a tapered haircut, utilizing the pronged extendable tube shown in FIG. 8.

Referring to FIGS. 8 and 9, extendable tube 40 is shown supplied with two extendable prongs 66 and **66*a*, located externally on opposite sides 70 of extendable tube 40, at open end 40***a* thereof, prongs 66 and 66*a* each being supplied with identical elongated slots 67, adapted to slide on slot guides 67*a* located externally on extendable tube 40. Identical clamping screws 68 project through slot 67 and are threaded into extendable tube 40, adapted to permit outer ends 69 of prongs 66 and 66*a* to be slideably extended beyond open end 40*a* to selected positions, whereafter prongs 66 and 66*a* are clamped onto extendable tube 40 by means of clamping screws 68. Prongs 66 and 66*a* are situated on opposite sides 70 of extendable tube 40, that are substantially intersected by a line extending along cutting edge 16 to sides 70.

Upon extending only one prong, for instance, prong 66, and locating open end 40*a* against scalp 71, cutting edge 16 becomes located at an angle to scalp 71, thereby permitting hair 72 to be cut in a tapered fashion, tapering substantially from the top of the head toward the neck, as hair cutter 10 is moved horizontally around scalp 71, along swath 71*a*, while cutting edge 16 is held in a plane that is substantially perpendicular to cutting swath 71*a*.

Upon extending both prongs 66 and 66*a* a substantially identical distance out from open end 40*a*, extendable tube 40 may be utilized to cut very curly hair, so-called "Afro styled" hair in the same manner as explained for the alternative attachment described in the following paragraph.

Figure 10:
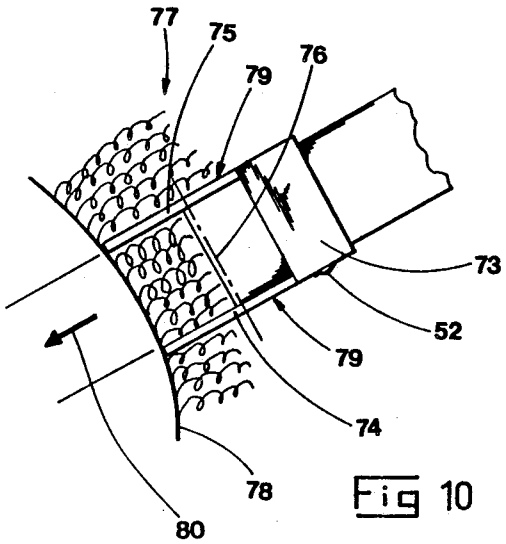
FIG. 10 is a partial side elevation of the haircutting device shown in FIG. 1 illustrating method of cutting very curly hair, socalled "Afro styled" hair, utilizing the alternate extendable tube shown in FIG. 5.

Referring to FIGS. 1 and 10, an alternate attachment for cutting very curly hair or so called "Afro styled hair" is shown comprising a pronged extendable tube 73, having 2 fixed prongs 74 and 75 extending outward from pronged extendable tube 73 and on diametrically opposite sides thereof. Fixed prongs 74 and 75 are located one at each end of a line 76 extending substantially through cutting edge 16, to permit prongs 74 and 75 to travel easily through very curly, "Afro styled" hair 77 on scalp 78 upon cutting edge 16 being held substantially perpendicular to the cutting swath 80 as the cutter is moved over the scalp along cutting swath 80. Pronged extendable tube 73 is supplied with a detent lever 52 as shown in FIG. 6 adapted to engage in shallow notches 49 in tubular housing 11.

A power cord 30 and switch means 31 for operating motor 22 may be located on handle means 29 or on housing 11 as convenient.

Referring to FIGS. 11 and 12, a method of illustrative programming means is shown, included in this invention and to be used in conjunction with the haircutting and trimming device embodying this invention.

FIG. 11 shows a side view of a potential haircut style, mapped out on an illustration of a scalp 83 divided in this illustration into 3 zones, 84, 85 and 86. A comparison mark 87 is included to indicate substantially the center of scalp 83.

FIG. 12 shows a rear view of the scalp 83, shown in FIG. 11, marked with the same comparison mark 87 and the same zones 84, 85 and 86 shown in FIG. 11, each zone being marked with an identifying figure as shown at 88, 89 and 90 to correspond with previously explained length indicating means 49*a* on tubular housing 11 to provide that hair within corresponding zones on a persons head is cut to correct lengths, to provide the hairstyle illustrated on the maps. Illustrations of modern haircut styles could include a larger or smaller number of zones than shown in this particular illustration.

The side view and rear view maps shown may be accompanied by photographs or drawings of the particular finished hair style to facilitate choosing a hair style, for instance from books containing a variety of hairstyles, new books being issued as hair styles change.

METHOD OF OPERATION

In operation, motor housing 21 with handle means 29 is rotated on tubular housing 11 to a position most convenient for either a left handed or a right handed operator. The extendable tube is extended to the desired length setting, for instance to comply with a particular illustrated program map, motor 22 is switched on, the open end 40*a* of extendable tube 40 is placed against scalp 42, and haircutting device 10 is moved over scalp 42 in a swath as required by the particular program map. The same procedure is carried out for the next portion of the program map until all required swaths have been completed. To cut tapered swaths, prong 66 is extended from extendable tube 40 to provide the required taper angle and the required swath is cut as per instructions on the program map to obtain a desired hairstyle.

Upon haircut having been completed or upon cut hair compartment 65 having been filled, cover 62 is removed and cut hair emptied out, whereafter cover 62 may be replaced ready for the next haircut.

Upon an Afro style hair being required to be cut, both opposite prongs 66 and 66*a* may be extended from extendable tube 40. Alternatively, pronged extendable tube 73 instead of extendable tube 40 may be located on housing 11 and extended to the required length. The motor is switched on and prongs 74 and 75 are located on scalp 78 with flat sides 79 positioned parallel to direction of cutting swath 80. As haircutting device 10 is passed over scalp 78, narrow edges 81 of prongs 74 and 75 will move easily through curly hair 77 which will be cut in curled position to a smooth outer surface and to lengths as required on hairstyling program map. Prongs 74 and 75 will eliminate excess suction that otherwise would tend to suck the curly hair into haircutting device 10 and cause curly hair 77 to be partially or wholly straightened out before cutting and provide lumpy or uneven haircut as hair 77 would curl back after cutting.

Upon it being required to cut hair close to the scalp as in a crew cut or to taper the hair right down to the scalp, for instance in the nape of the neck, secondary airguide 46, that is detachably attached to cover, 62, for instance by slats 46*a* on airguide 46, that fit into slots 82 in cover 62, is removed from cover 62 to permit cutting edge 16 to be positioned close to scalp 42.

It will be understood that although specific embodiments of the invention have herein been described and illustrated, the invention also contemplates variations in design and method as may hold within the scope of the appended claims.

I claim:

1. A manually portable, selfcontained haircutting and trimming device comprising a tubular housing having one open end and an opposite closed end, oscillating cutter blade means located within said tubular housing transversely thereof and substantially at said open end of said housing, said cutter blade means having a stationary blade and an oscillating blade, said cutter blade means being supplied with cutting teeth along one edge thereof, seal means located between all other edges of said stationary blade and said housing, motor means attached to said housing at said closed end, impeller means on said motor means, exhaust openings in said motor means, said closed end of said housing being supplied with an opening, air passage space located between said cutting teeth and said housing to provide passage for an air stream provided by said impeller, said airstream being adapted to progress from said open end of said housing through said opening in said closed end to said exhaust openings in said motor means, drive means in said haircutting device adapted to apply oscillating motion to said oscillating blade, cut hair reservoir means located between said cutter blade means and said exhaust openings, filter means located between said cut hair reservoir means and said exhaust openings, said filter means being adapted to permit said airstream freely to pass therethrough from said cut hair reservoir, yet to prevent said cut hair to pass therethrough, air guide means located in said airstream in front of said cutting teeth, around said cutting teeth and down behind said cutting teeth, said air guide means being adapted to guide said airstream to force the hair, drawn into said housing by said airstream, to enter said cutting teeth and be cut thereby, vacuum breaking means located at said open end of said housing, releasably unidirectional, and incrementally extendable extension means attached at said open end of said housing, to selectively position said cutting teeth relative to the scalp of a person having hair cut by said hair cutting device.

2. A manually portable, selfcontained haircutting and trimming device as claimed in claim 1 in which said drive means comprises connection means between said motor means and said cutter blade means.

3. A manually portable, selfcontained haircutting and trimming device as claimed in claim 1 in which said incrementally extendable extension means includes at least one incrementally extendable tube having an outer end supplied with at least one prong, axially extendable outward from said outer end and fastening means on said incrementally extendable tube for fastening said at least one prong in any selected, axially extended position on said incrementally extendable tube to permit taper cutting of said hair to a selected angle of taper.

4. A manually portable, selfcontained haircutting and trimming device as claimed in claim 1 in which said incrementally extendable extension means comprises at least one supplementary extendable tube detachably attachable to said open end of said housing and axially slideable on said housing to selectively permit an outer end of said extendable tube to extend out past said open end of said housing, said outer end of said extendable tube having a rim, said rim of said outer end of said extendable tube containing a plurality of vacuum breaking slots and fastening means on said extendable tube for fastening said extendable tube on said housing in any selected extended position.

5. A manually portable, selfcontained haircutting and trimming device comprising a tubular housing having one open end and an opposite closed end, oscillating cutter blade means located within said tubular housing transversely thereof and substantially at said open end of said housing, said cutter blade means having a stationary blade and an oscillating blade, said cutter blade means being supplied with cutting teeth along one edge thereof, seal means located between all other edges of said stationary blade and said housing, motor means attached to said housing at said closed end, impeller means on said motor means, exhaust openings in said motor means, said closed end of said housing being supplied with an opening, air passage space located between said cutting teeth and said housing to provide passage for an air stream provided by said impeller, said airstream being adapted to progress from said open end of said housing through said opening in said closed end to said exhaust openings in said motor means, drive means in said haircutting device adapted to apply oscillating motion to said oscillating blade, cut hair reservoir means located between said cutter blade means and said exhaust openings, filter means located between said cut hair reservoir means and said exhaust openings, said filter means being adapted to permit said airstream freely to pass therethrough from said cut hair reservoir, yet to prevent said cut hair to pass therethrough, air guide means located in said airstream in front of said cutting teeth, around said cutting teeth and down behind said cutting teeth, said air guide means being adapted to guide said airstream to force the hair, drawn into said housing by said airstream, to enter said cutting teeth and be cut thereby, vacuum breaking means located at said open end of said housing, releasably unidirectional, and incrementally extendable extension means attached at said open end of said housing including incremental control means to selectively position said cutting teeth relative to the scalp of a person having hair cut by said hair cutting device, and descriptive hair style programming means co-operative with said incrementally extendable extension means to selectively provide varying hair lengths on selected portions of said scalp.

6. A manually portable, selfcontained haircutting and trimming device as claimed in claim 5, in which said incremental control means comprises a plurality of shallow notches incrementally located along an outer wall of said housing, at least one detent lever, pivotably attached on said extendable tube, spring means on said detent lever to bias one end of said detent lever toward said notches, said one end of said detent lever being adapted to be selectively engaged in said notches, the other end of said detent lever being adapted to be manually depressed to pivotally disengage said one end from said notches for changing position of said extendable tube on said housing, hair length indicating means on said housing corresponding to each said selectively engaged incremental notch, said indicating means being adapted to be co-operative with said descriptive hair style programming means.

7. A manually portable, selfcontained haircutting and trimming device as claimed in claim 6 in which said releasably unidirectional, incrementally extendable extension means is provided by said detent lever and shallow notch combination being provided with a pawl and ratchet configuration to permit said extendable tube to be readily drawn away from said motor means without requiring manual release pressure on said detent lever, yet permitting said extendable tube to move toward said motor means only upon manual pressure being applied on said detent lever to move said one end of said detent lever out of engagement with said notches, thereby making said haircutting device failsafe by preventing said hair from being accidentally cut too short.

8. A manually portable, selfcontained haircutting and trimming device as claimed in claim 4 in which one of said at least one supplementary extendable tubes contains a pair of oppositely positioned prongs extending outward of said outer end of said extendable tube, said pair of prongs having sufficient length to permit said haircutting device, upon being passed over a scalp, to cut very curly hair to an adjustably selected height over said scalp without said airstream straightening out said very curly hair, said prongs having a sufficiently narrow thickness to permit said prongs to pass over said scalp and through said curly hair without unduly disturbing the curls of said curly hair.

9. A manually portable, selfcontained haircutting and trimming device as claimed in claim 1 in which said motor means is supplied with handle means extending radially outward from said motor means substantially at center of gravity of said haircutting and trimming device.

10. A manually portable, selfcontained haircutting and trimming device as claimed in claim 9 in which said motor means is detachably attached on said housing at said closed end, said motor means being selectively rotatable on said closed end of said housing to permit changing position of said handle means relative to said cutting teeth in said edge of said stationary cutting blade to facilitate use of said haircutting and trimming device by a left handed or a right handed operator respectively and fastening means for fastening said motor means to said housing in said selected position.

11. A manually portable, selfcontained haircutting and trimming device as claimed in claim 1 in which said stationary blade is located substantially flush with said open end of said housing, said airguide located in front of said cutting teeth being removable, thereby to provide that at least one end of said edge containing said cutting teeth may be positioned close to said scalp to permit taper cutting of said hair down to said scalp or to provide a very close haircut.

12. A manually portable, selfcontained haircutting and trimming device as claimed in claim 1 in which said cut hair reservoir is supplied with detachably attachable cover means to facilitate emptying said cut hair reservoir.

13. A manually portable, selfcontained haircutting and trimming device as claimed in claim 12 in which at least one of said air guide means is attached to said cover to facilitate access to said cutting teeth upon removal of said cover for emptying said cut hair from said cut hair reservoir and said cutting teeth.

14. The invention of claim 1, further including descriptive hair style programming means co-operative with said incrementally extendable extension means, said programming means selectively describing desired adjustments of said incrementally extendable extension means for various zones of said scalp, thus providing the desired haircut lengths in said zones.

* * * * *